US010177466B2

(12) United States Patent
Hung et al.

(10) Patent No.: US 10,177,466 B2
(45) Date of Patent: Jan. 8, 2019

(54) PIERCING-THROUGH STRUCTURE FOR CONNECTOR

(71) Applicant: OUTDOOR SOLUTIONS ELECTRONICS CO., LTD., New Taipei (TW)

(72) Inventors: Jui Chih Hung, New Taipei (TW); Feng Ching Hsueh, New Taipei (TW)

(73) Assignee: OUTDOOR SOLUTIONS ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 15/702,261

(22) Filed: Sep. 12, 2017

(65) Prior Publication Data

US 2018/0083373 A1 Mar. 22, 2018

(30) Foreign Application Priority Data

Sep. 21, 2016 (TW) ..... 105214404 U

(51) Int. Cl.
*H01R 4/26* (2006.01)
*H01R 13/405* (2006.01)

(52) U.S. Cl.
CPC ..... *H01R 4/26* (2013.01); *H01R 13/405* (2013.01)

(58) Field of Classification Search
CPC ..... H01R 4/26; H01R 11/00; H01R 13/405
See application file for complete search history.

(56) References Cited

U.S. PATENT DOCUMENTS 3,846,738 A * 11/1974 Nepovim ..... H01R 9/05 439/584
4,614,395 A * 9/1986 Peers-Trevarton ..... A61N 1/3752 29/881
5,352,134 A * 10/1994 Jacobsen ..... H01R 9/0521 439/583
5,651,698 A * 7/1997 Locati ..... H01R 9/0521 439/578

(Continued)

FOREIGN PATENT DOCUMENTS

TW M465692 U 11/2013

*Primary Examiner* — James Harvey
*Assistant Examiner* — Oscar Jimenez
(74) *Attorney, Agent, or Firm* — Muncy, Geissler, Olds & Lowe, P.C.

(57) ABSTRACT

The present invention provides a piercing-through structure for a connector, comprising a hollow-core body, a lead, and a receptacle. Wherein a front connection portion is disposed at a front end of the hollow-core body; a plurality of wires extending forward is disposed at a front end of the lead disposed at a rear segment in the hollow-core body; and a plurality of metallic spikes is disposed at a front end of the connector of the receptacle and a connection sleeve movably fits around a front end of the body. So that connecting the hollow-core body and the receptacle together enables the connection sleeve of the receptacle to fit around the front connection portion of the hollow-core body, allowing the metallic spikes to pierce across surfaces of the wires such that, after piercing insulating sheaths of the wires, the metallic spikes come into contact with metallic cores of the wires, so as to achieve electrical connection of the connector of the receptacle and the wires of the hollow-core body.

6 Claims, 5 Drawing Sheets

(56) References Cited

U.S. PATENT DOCUMENTS

| | | | | |
|---|---|---|---|---|
| 8,986,044 | B2 * | 3/2015 | Meister | H01R 9/0503 439/578 |
| 9,608,342 | B2 * | 3/2017 | Tait | H01R 4/70 |
| 2003/0224657 | A1 * | 12/2003 | Malloy | H01R 9/0521 439/578 |
| 2014/0106614 | A1 * | 4/2014 | Burris | H01R 9/0527 439/578 |
| 2016/0372860 | A1 * | 12/2016 | D'Addario | H01R 13/5845 |

* cited by examiner

PIERCING-THROUGH STRUCTURE FOR CONNECTOR

BACKGROUND OF THE INVENTION

1. Technical Field

The present invention relates to a piercing-through structure for a connector and, more particularly, to a structure for rotationally piercing insulating sheaths of wires to electrically connect a hollow-core body and a receptacle upon connection thereof.

2. Description of Related Art

A conventional connector structure, such as Taiwan utility model application no. 102213752, entitled Cable Connector Operating Without Crimping Tool, comprises an outer ring, a hollow-core inner cylinder and an annular nut. The annular nut rotates relative to the outer ring. The hollow-core inner cylinder moves axially relative to the outer ring and prevents the hollow-core inner cylinder from falling under the action of a stop portion of the annular nut. To be mounted, a cable is inserted into a cable insertion segment inside the outer ring through a passage leading to the outer ring and opposite the annular nut and then positioned in place. Afterward, the hollow-core inner cylinder is pushed into the outer ring; alternatively, insertion of the hollow-core inner cylinder into the outer ring for positioning is attained by rotation of the annular nut relative to an abutting element. The cable is clamped between a second clamping portion of the hollow-core inner cylinder and a first clamping portion of the outer ring and thus fixed in place, thereby fulfilling the objective of mounting and operating a connector structure easily without a dedicated crimping tool.

Although the conventional connector structure can be mounted and operated easily without a dedicated crimping tool, it fails to electrically connect a connector body and a receptacle upon connection thereof by rotationally piercing insulating sheaths of wires. As a result, the conventional connector structure is not only inconvenient but also fails to meet practical needs.

Therefore, the aforesaid conventional connector structure has drawbacks and thus still has room for improvement.

In view of this, the inventor of the present invention strives for improvement of the aforesaid conventional connector structure, conducted evaluation thereof, carried out a related design process according to the inventor's years of experience in the manufacturing, development and design of related products, and finally put forth the present invention which has high industrial practicability.

BRIEF SUMMARY OF THE INVENTION

The primary objective of the present invention is to provide a piercing-through structure for a connector and to a structure for rotationally piercing insulating sheaths of wires to electrically connect a hollow-core body and a receptacle upon connection thereof.

According to the objective, the piercing-through structure for a connector, comprising a hollow-core body, a lead, and a receptacle, wherein a front connection portion is disposed at a front end of the hollow-core body; a plurality of wires extending forward is disposed at a front end of the lead disposed at a rear segment in the hollow-core body; and a plurality of metallic spikes is disposed at a front end of the connector of the receptacle and a connection sleeve movably fits around a front end of the body. Therefore, connecting the hollow-core body and the receptacle together enables the connection sleeve of the receptacle to fit around the front connection portion of the hollow-core body, allowing the metallic spikes to pierce across surfaces of the wires such that, after piercing insulating sheaths of the wires, the metallic spikes come into contact with metallic cores of the wires, so as to achieve electrical connection of the connector of the receptacle and the wires of the hollow-core body.

DETAILED DESCRIPTION OF THE EMBODIMENT OF THE INVENTION

Objectives, shapes, characteristics of structures, and effects of the present invention would be illustrated in detail with reference to the accompanying drawings herein. Furthermore, for easier illustrating, the drawings of the present invention are not a certainly the practical proportion and are not limited to the scope of the present invention.

Figure 1:
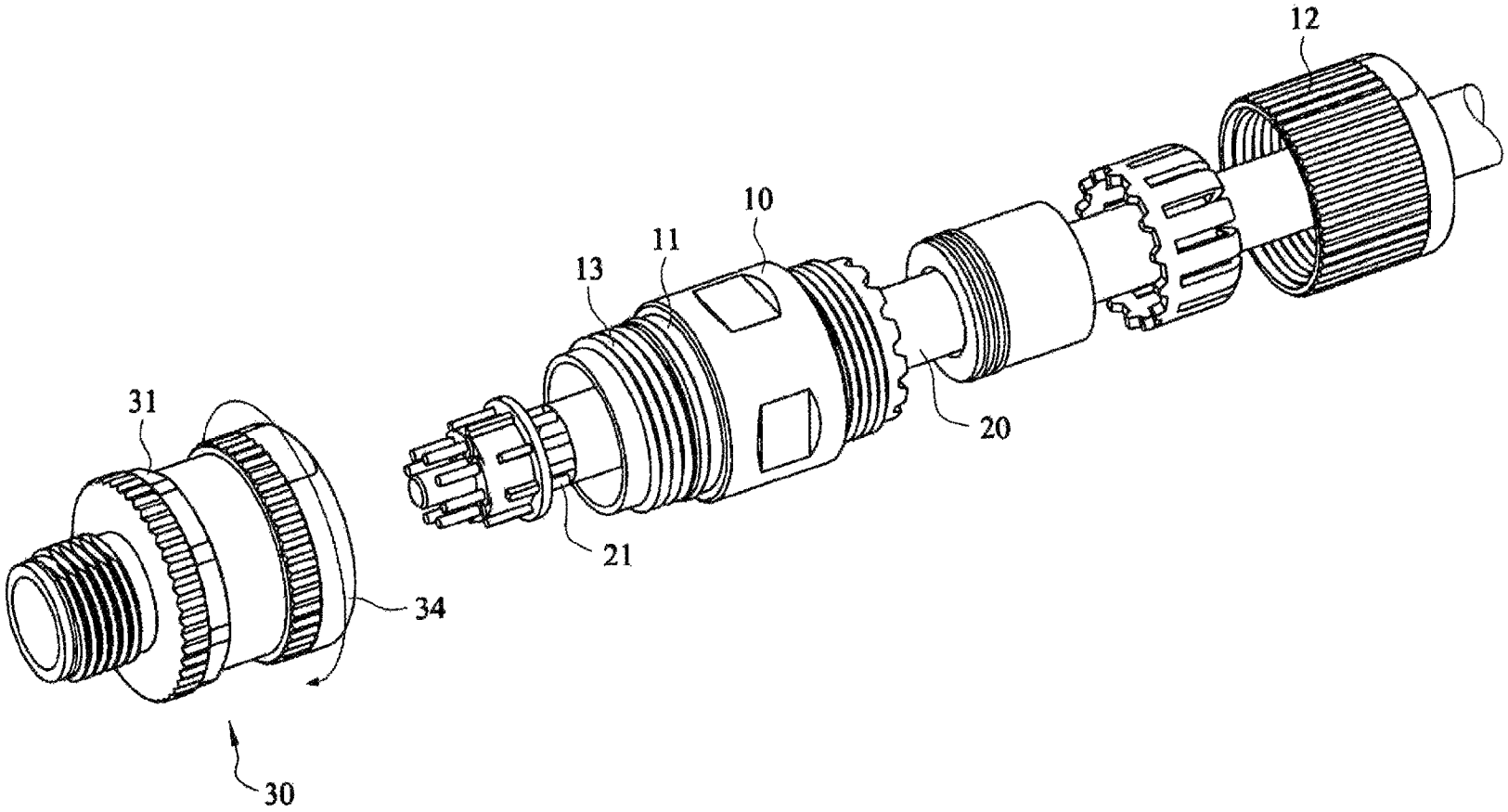
FIG. 1 shows an exploded breakdown view of an embodiment of the piercing-through structure for a connector in the present invention.
Figure 2:
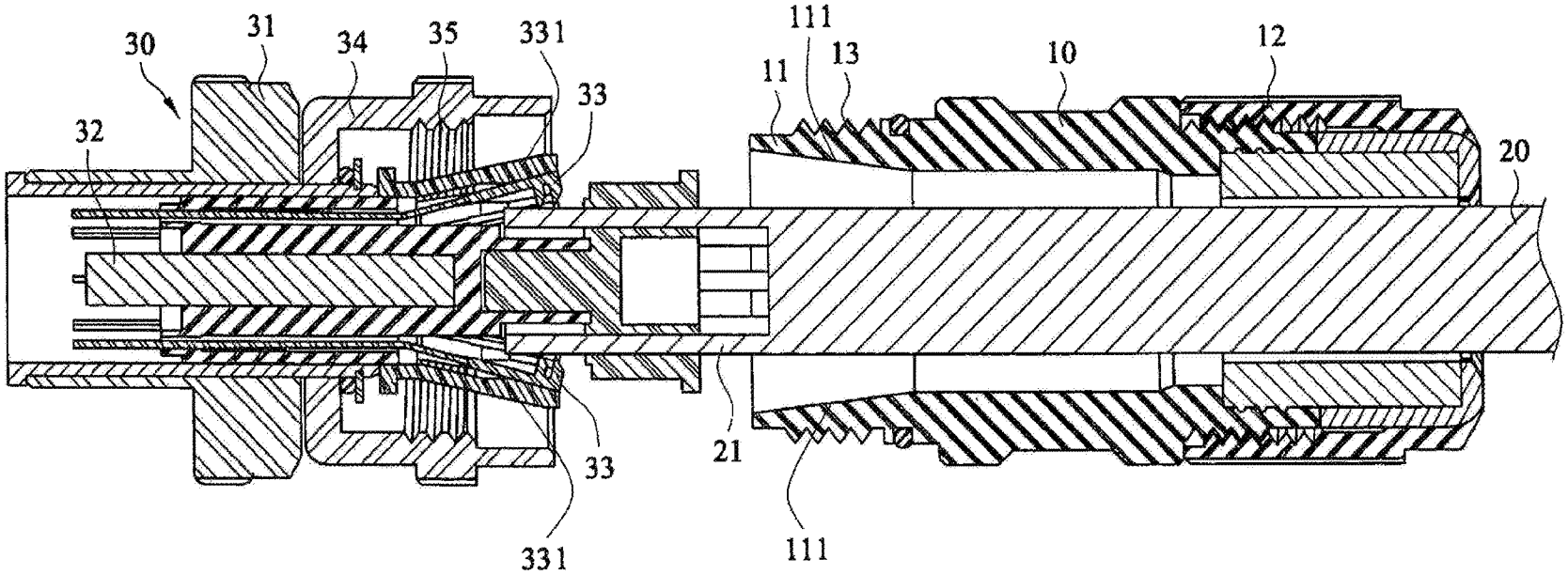
FIG. 2 to 5 show sectional schematic views in consecutive motions of an embodiment of the piercing-through structure for a connector in the present invention.
Figure 3:
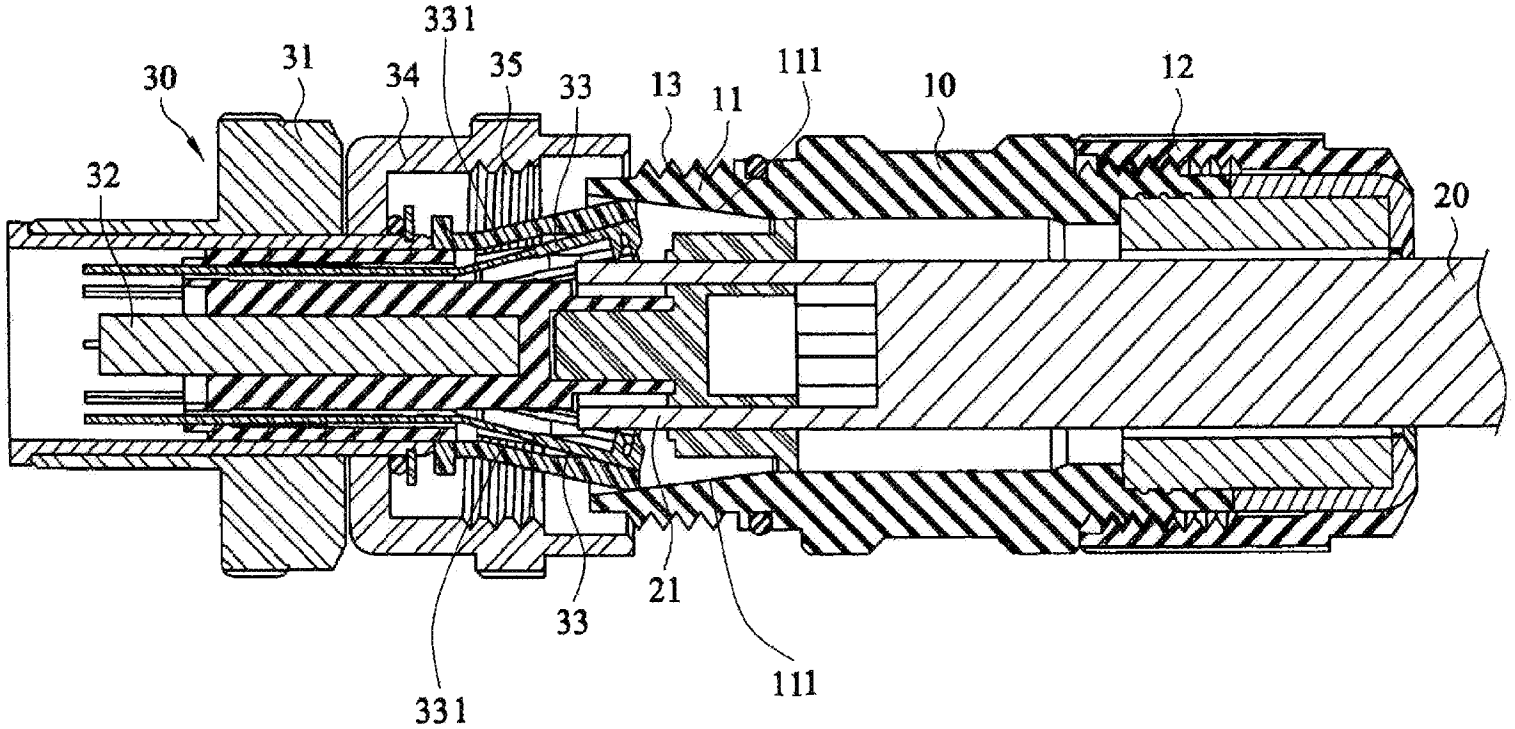
Figure 4:
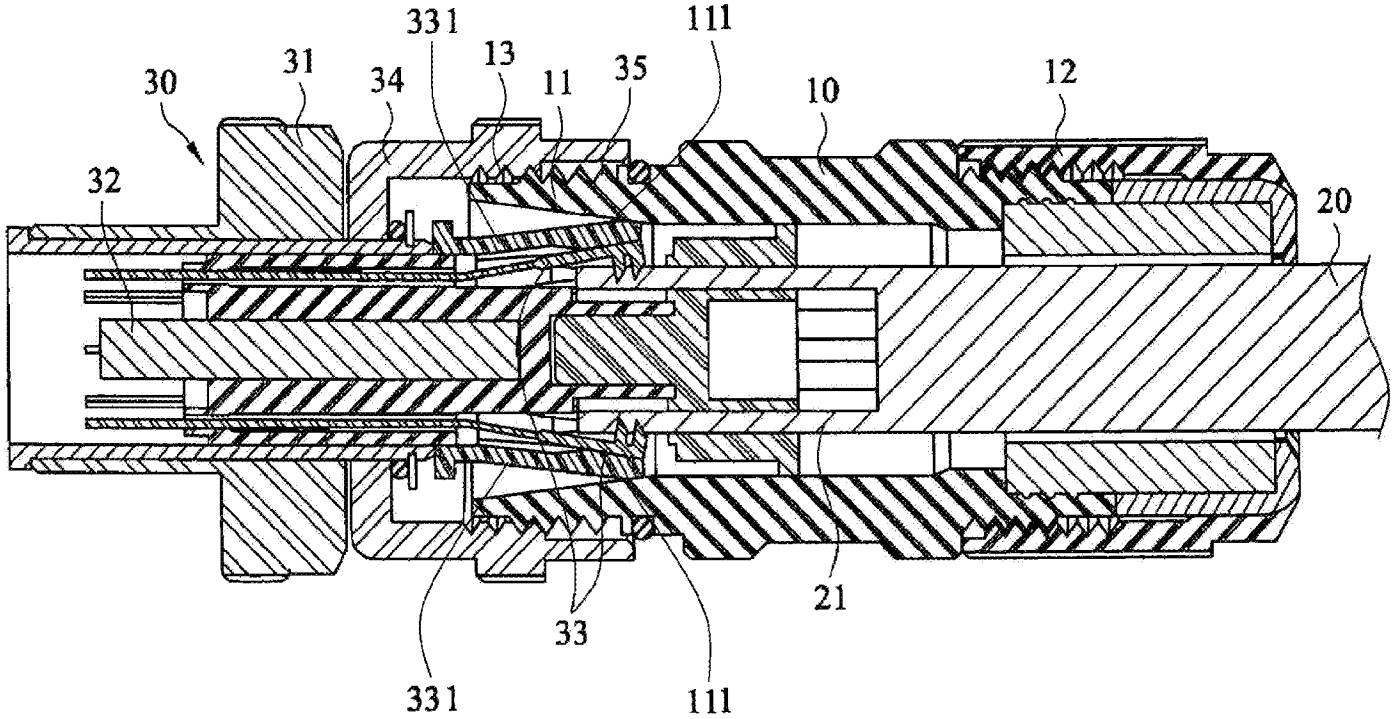
Figure 5:
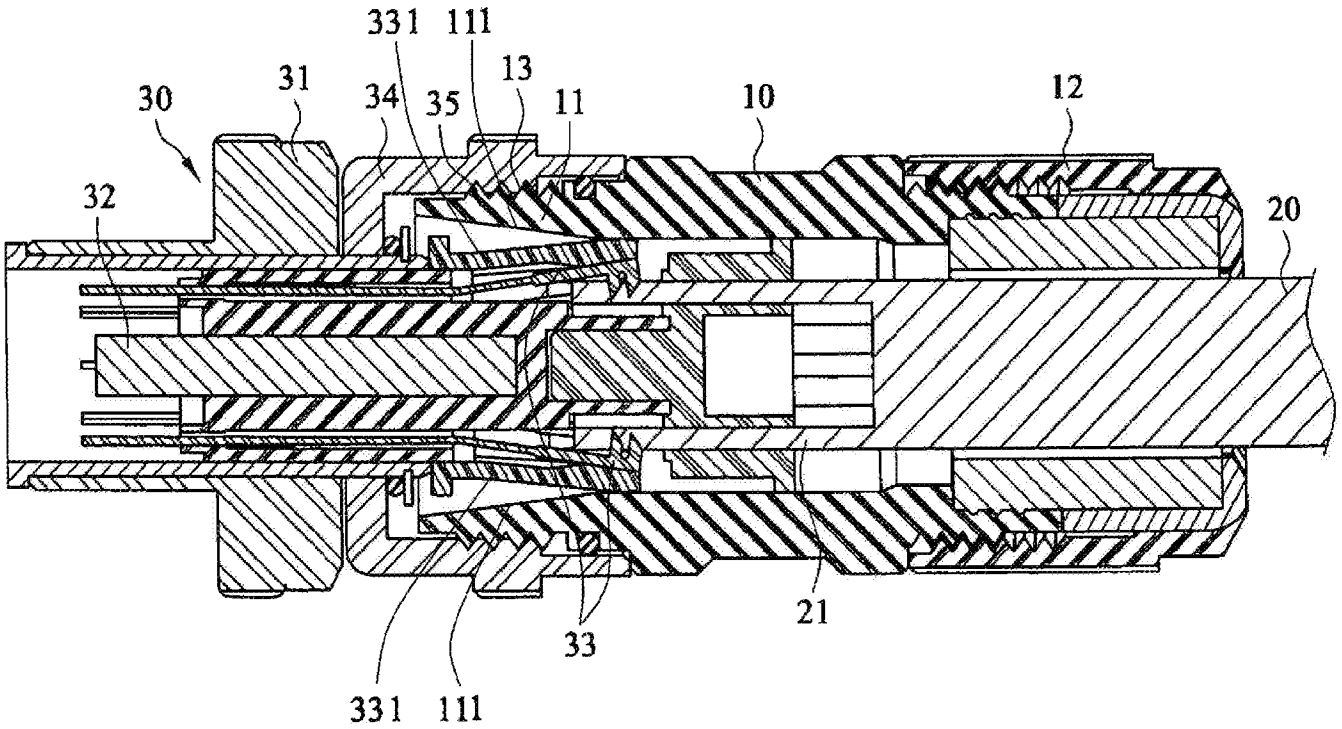

The present invention relates to a piercing-through structure for connector. Referring to FIGS. 1-5, according to the present invention, the piercing-through structure for a connector essentially comprises a hollow-core body 10, a lead 20 and a receptacle 30.

A front connection portion 11 is disposed at the front end of the hollow-core body 10. A rear protective sleeve 12 is connected to the rear end of the hollow-core body 10. An outer thread 13 is disposed on the surface of the front connection portion 11.

The lead 20 is disposed at a rear segment in the hollow-core body 10. A plurality of wires 21 extending forward is disposed at the front end of the lead 20.

The receptacle 30 has a body 31. The body 31 has therein a connector 32 which the wires 21 are connected to. A plurality of metallic spikes 33 is disposed at the front end of the connector 32. A connection sleeve 34 movably fits around the front end of the body 31. An inner thread 35 which matches the outer thread 13 is disposed on an inner wall of the connection sleeve 34.

Referring to FIGS. 2-5, given the aforesaid components, upon connection of the hollow-core body 10 and the receptacle 30, the connection sleeve 34 of the receptacle 30 fits around the front connection portion 11 of the hollow-core body 10, and the connection sleeve 34 is coupled to the front connection portion 11 by screwing. Rotation, which is accompanied by the aforesaid screwing process, allows the metallic spikes 33 to pierce across surfaces of the wires 21 such that, after piercing insulating sheaths of the wires 21, the metallic spikes 33 come into contact with metallic cores of the wires 21, so as to achieve electrical connection of the connector 32 of the receptacle 30 and the wires 21 of the hollow-core body 10. Therefore, the present invention achieves the objective of achieving electrical connection without peeling off the insulating sheaths at the front end of the wires 21 in advance.

Referring to FIGS. 2-5, the metallic spikes 33 have resilience.

In a preferred embodiment, an oblique wall 111 which tapers inward is disposed on an inner edge of the front connection portion 11, whereas a resilient support arm 331 is disposed on one side of each metallic spike 33. When the connection sleeve 34 is coupled to the front connection portion 11 (for example, the aforesaid screwing process), the resilient support arm 331 moves from a wide side of the oblique wall 111 in the tapering direction; meanwhile, the resilient support arm 331 pushes the metallic spikes 33 inward along the oblique wall 111, so as to allow the metallic spikes 33 to pierce the insulating sheaths of the wires 21, thereby achieving electrical connection. In another preferred embodiment, the resilient support arm 331 can also be dispensed with, as the oblique wall 111 pushes the metallic spikes 33 inward and thus enables them to pierce the insulating sheaths of the wires 21, thereby achieving electrical connection.

Compared with the prior art, the piercing-through structure for a connector according to the present invention has advantages as follows:

Rotationally piercing insulating sheaths of wires to electrically connect a hollow-core body and a receptacle upon connection thereof, thereby achieving electrical connection without peeling off the insulating sheaths at the front end of the wires in advance.

In summary, the piercing-through structure for a connector has an innovative structure that has not ever seen before in any publication and commercial product, therefore, the present invention has a novelty without doubt. Further, the unique techniques and functions of the present invention is much better than the prior art, so that the present invention has an inventive step. The present invention conform the patent law so as to submit the utility patent application.

The present invention is more detailed illustrated by the above preferable example embodiments. While example embodiments have been disclosed herein, it should be understood that other variations may be possible. Such variations are not to be regarded as a departure from the spirit and scope of example embodiments of the present application, and all such modifications as would be obvious to one skilled in the art are intended to be included within the scope of the following claims.

What is claimed is:

1. A piercing-through structure for a connector, comprising:

a hollow-core body, wherein a front connection portion is disposed at a front end of the hollow-core body;

a lead disposed at a rear segment in the hollow-core body, wherein a plurality of wires extending forward is disposed at a front end of the lead; and a receptacle having a body with a connector disposed in the body to connect with the wires, wherein a plurality of metallic spikes is disposed at a front end of the connector, each of the metallic spikes comprises a sharp end, and a connection sleeve movably fits around a front end of the body, wherein connecting the hollow-core body and the receptacle together enables the connection sleeve of the receptacle to fit around the front connection portion of the hollow-core body, allowing the metallic spikes cutting through surfaces of the wires such that, after the sharp end cutting through insulating sheaths of the wires, the metallic spikes come into contact with metallic cores of the wires, so as to achieve electrical connection of the connector of the receptacle and the wires of the hollow-core body.

2. The piercing-through structure for a connector of claim 1, wherein the metallic spikes have resilience.

3. The piercing-through structure for a connector of claim 1, wherein the front connection portion disposes an outer thread on the surface and the inner wall of the connection sleeve disposes an inner thread matched the outer thread.

4. The piercing-through structure for a connector of claim 1, wherein the rear end of the hollow-core body connects a rear protective sleeve.

5. The piercing-through structure for a connector of claim 1, wherein an inner edge of the front connection portion disposes an oblique wall tapered inward.

6. The piercing-through structure for a connector according to claim 5, wherein a resilient support arm is disposed on a side of each said metallic spike such that, when the connection sleeve is coupled to the front connection portion, the resilient support arm pushes the metallic spikes inward along the oblique wall, so as to allow the metallic spikes to pierce the insulating sheaths of the wires.

* * * * *